United States Patent [19]

Ramsey

[11] Patent Number: 5,073,310

[45] Date of Patent: Dec. 17, 1991

[54] AIR INJECTOR ASSEMBLY

[75] Inventor: John I. Ramsey, Harrisburg, Pa.

[73] Assignee: Water Master, Inc., Harrisburg, Pa.

[21] Appl. No.: 591,679

[22] Filed: Oct. 1, 1990

[51] Int. Cl.[5] ..... B01F 3/04

[52] U.S. Cl. ..... 261/76; 261/DIG. 75

[58] Field of Search ..... 261/76, DIG. 75

[56] References Cited

U.S. PATENT DOCUMENTS

| | | | |
|---|---|---|---|
| Re. 21,416 | 4/1940 | Sargent | 261/DIG. 75 |
| 721,036 | 2/1903 | Gwynne et al. | 261/DIG. 75 |
| 1,801,553 | 4/1931 | Heimburger | 261/DIG. 75 |
| 2,797,904 | 7/1957 | Voorheis | 261/DIG. 54 |
| 3,282,227 | 11/1966 | Nielsen | 261/DIG. 75 |
| 3,451,409 | 6/1969 | Roche | 261/DIG. 54 |
| 3,646,607 | 2/1972 | Dower | 137/604 |
| 3,669,424 | 6/1972 | Shiobara et al. | 261/63 |
| 3,693,656 | 9/1972 | Sauer | 137/604 |
| 4,057,602 | 11/1977 | Kolm | 55/226 |
| 4,098,851 | 7/1978 | Schute et al. | 261/76 |
| 4,105,721 | 8/1978 | Schliebe | 261/76 |
| 4,167,401 | 9/1979 | Kelnyke | 261/63 |
| 4,262,371 | 4/1981 | Berry et al. | 4/191 |
| 4,389,931 | 6/1983 | Beard | 261/77 |
| 4,412,568 | 11/1983 | Hughes | 141/392 |
| 4,562,014 | 12/1985 | Johnson | 261/DIG. 75 |
| 4,624,626 | 11/1986 | Sherfinski et al. | 261/DIG. 75 |
| 4,842,777 | 6/1989 | Lamort | 261/DIG. 75 |
| 4,885,084 | 12/1989 | Doyle | 261/DIG. 75 |
| 4,927,568 | 5/1990 | Campau | 261/DIG. 75 |

*Primary Examiner*—Tim Miles

*Attorney, Agent, or Firm*—Pollock, Vande Sande & Priddy

[57] ABSTRACT

An air injector assembly has an input port and an output port connected by a bypass bore and tapered bore. Fitted within the tapered bore is an air injector mechanism which contains a throat and a venturi nozzle portion. The opening of the bypass bore can be varied so that the amount of water passing therethrough is controlled to regulate the pressure being received at the input port which represents the back pressure on a pump. By varying the opening of the bypass bore, the back pressure of the pump can be regulated so that the pump may operate safely. Air is injected into the air injector assembly when water is pushed through the throat and into the venturi nozzle. A cavity is formed at the junction where the throat is coupled to the venturi nozzle so that air can be drawn thereat to aerate and oxidize the water passing therethrough. By aerating and oxidizing the water, hydrogen sulfide is removed and iron is precipitated, and can be removed later. An air supply assembly provides a safety valve which only allows air to be drawn into the air injector assembly.

16 Claims, 4 Drawing Sheets

AIR INJECTOR ASSEMBLY

FIELD OF THE INVENTION

The present invention relates to a venturi device and more particularly to an air injection device for aerating and oxidizing water being sent to a dwelling and to ensure the proper activation of a pump, if any, for pumping the water into the dwelling.

BACKGROUND OF THE INVENTION

When pumped from a well, oftentimes water tends to have a large concentration of hydrogen sulfide which gives the water an unpleasant odor akin to rotten egg. So, too, the water usually contains a larger than desired amount of iron which cakes to the inside circumference of the pipes and discolors almost anything it comes into contact with, as for example when the water is used for washing clothes.

Prior to the instant invention, to overcome the hydrogen sulfide smell, the water is chemically treated and an iron filter used to remove the iron. However, some of the chemicals used, which likewise may be undesirable, would remain in the water. Also, there may be insufficient precipitation of the iron from the water.

A prior art device which may be used to oxidize water is disclosed in Nielsen U.S. Pat. No. 3,282,227. Essentially, the Nielsen device comprises two coaxial sections, jointed together by a collar which also is used to adjust the amount of water flowing through the sections. A venturi tube is positioned within the two coaxial sections. At the end of the venturi tube where the water is output there is formed a radially enlarged section for restricting the water passing around the venturi. Thus, with water passing between the outside of the venturi and the inside circumference of the coaxial sections, and through the venturi itself, a differential pressure is created at the output of the coaxial sections. Consequently, by turning the collar, different amounts of air may be drawn into the venturi. But inasmuch as the Nielsen device is made of three different sections, with the coaxial sections extending or contracting (from the collar) depending on which way the jointing collar is turned, it becomes difficult to splice the Nielsen device between two water pipes which are usually separated by a fixed distance not amendable to movement.

BRIEF DESCRIPTION OF THE PRESENT INVENTION

The present invention air injector assembly has a main body member threaded at both ends for mating with input and output pipes. The central portion of the body member is solid except for two through bores which connect the input port, where the water from the input pipe is received, and the output port, where the water is to be fed to the output pipe. Into one of the through bores an air injection mechanism comprising a throat portion and a venturi nozzle portion is fitted. At the junction where the throat portion is coupled to the venturi nozzle portion there is formed a cavity fluidly connected to an aperture extending to the outside of the body member, and connected to an air supply mechanism. To provide adaptability for different pump pressures and amounts of water flowing therethrough, the respective diameters of both the throat and venturi nozzle portions may be of different sizes. The other through bore is a bypass channel whose opening can be varied by an adjustment plug member to control the amount of water passing therethrough and, as a consequence, the amount of water traversing through the throat and venturi nozzle sections, thereby regulating the amount of air to be sucked into the member for aerating and oxidating the water.

An additional feature of the present invention includes at least one pressure gauge mated to the input port for measuring the back pressure of the water (fed from a water pump) being input to the air injector assembly so that appropriate adjustment of the water pressure can be made to ensure safe operation of the water pump. An output gauge may also be added to the air injector assembly, at its output port, for providing indication of the pressure at which the water pump is to turn off.

It is therefore an objective of the present invention to provide an air injector assembly that, by aerating and oxidizing the water passing therethrough, can effectively remove substantial amounts of hydrogen sulfide and iron from the water.

It is another objective of the present invention to provide a body member fixedly connected to incoming and outgoing pipes.

It is yet another objective of the present invention to provide an air injector assembly that can be used to monitor the back pressure on a pump and adjust the pressure of the water accordingly.

BRIEF DESCRIPTION OF THE FIGURES

The above-identified mentioned objectives and advantages of the present invention will become more apparent and the invention itself will be best understood by reference to the following description of an embodiment of the invention taken in conjunction with the accompanying drawings, wherein.

DETAILED DESCRIPTION OF THE PRESENT INVENTION

Figure 1:
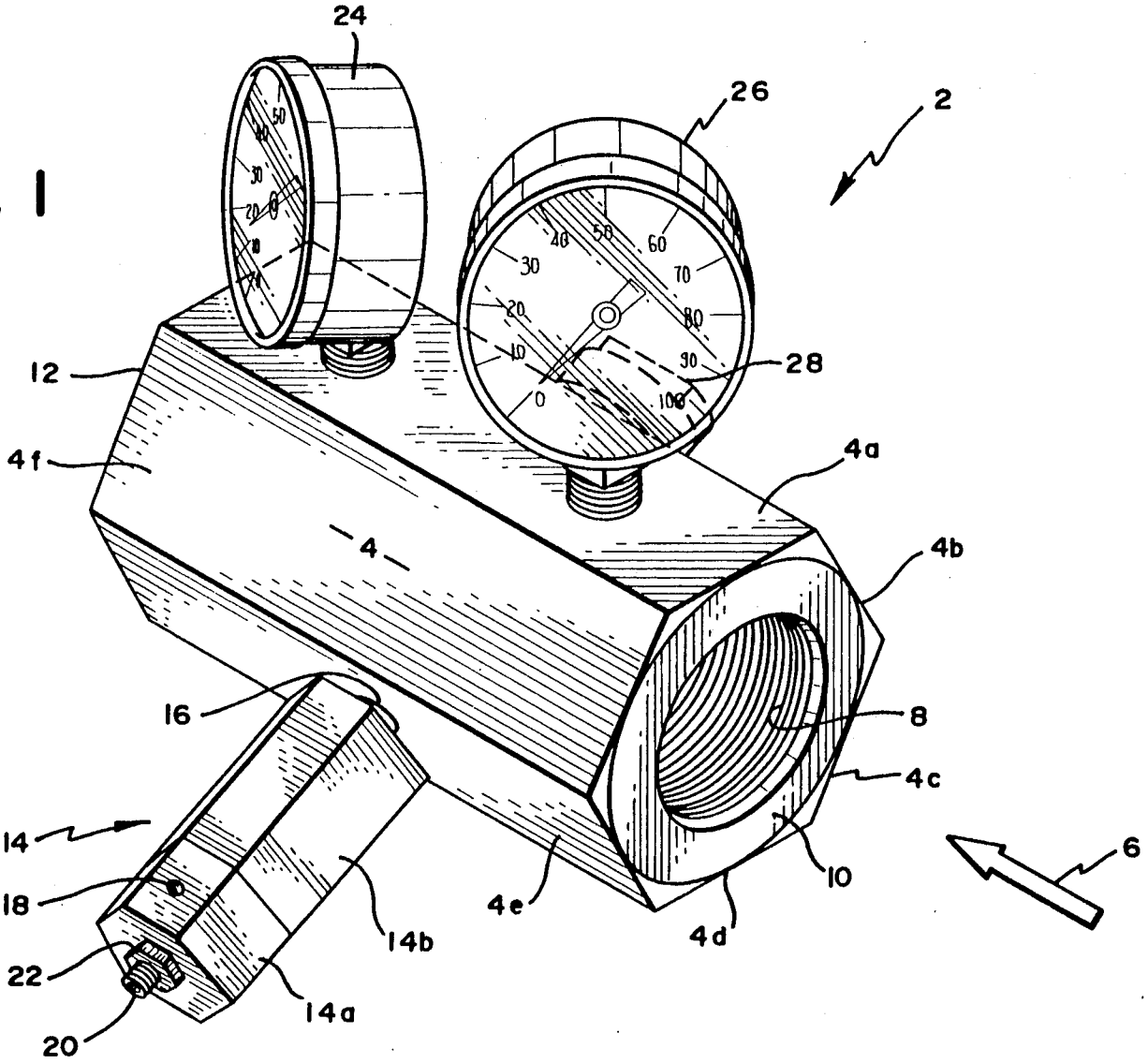
FIG. 1 is a perspective view of the air injector assembly of the present invention.

A perspective view of the present invention air injector assembly 2 is illustrated in FIG. 1. As shown, air injector assembly 2 has a body member 4 through which a fluid such as water, indicated by arrow 6, passes or traverses. Although not limiting to such, as shown in FIG. 1, body member 4 has six (6) surfaces 4a–4f of which opposing surfaces may be clamped by a wrench for threadedly mating the body member to fluid carrying input and output pipes (not shown) via threads 8 at end 10 and similar but not shown threads at end 12, respectively.

An air supply assembly 14 comprising a housing consisting of portions 14a and 14b is threadedly mated to a passage integrated to member 4 at location 16. On housing portion 14a there is a hole 18 through which air is sucked or drawn into, and fed to member 4. Also shown connected to the end of housing portion 14a is an adjustment screw 20 and a locking nut 22 both of whose functions will be discussed later. Further shown in FIG. 1 as being mated to member 4 are pressure gauges 24 and 26 respectively connected to an output port and an input port of member 4 which likewise will be discussed. Pressure gauges 24 and 26 are conventional gauges which, as shown, are threadedly mated to corresponding apertures integrated to member 4.

A bypass adjust assembly 28, whose construction and functions will be discussed later, is also mated to member 4, for example at surface 4b.

Figure 2C:
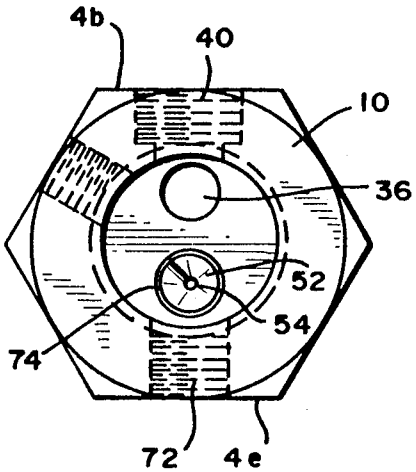
FIG. 2C is the other end view of the FIG. 2A body member.
Figure 2A:
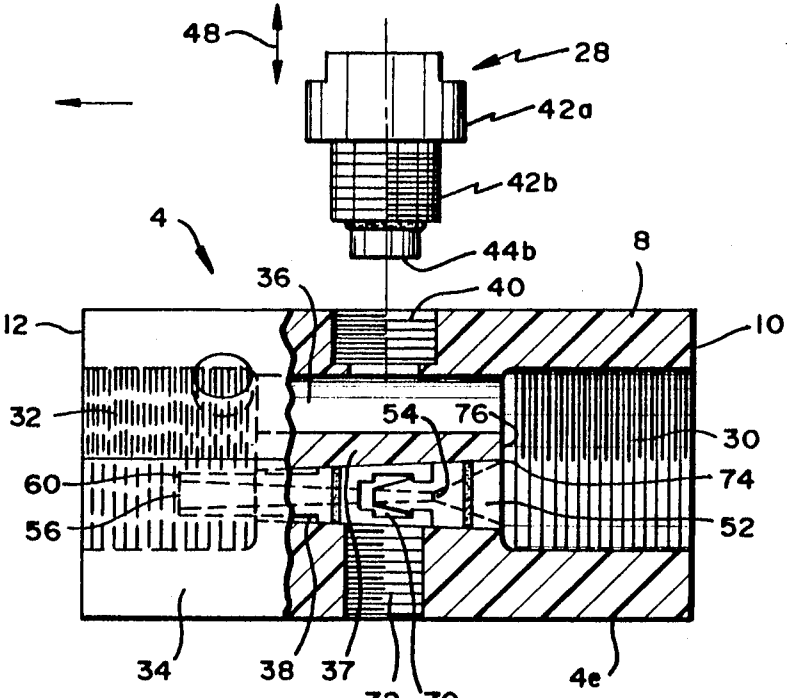
FIG. 2A is a semi-exposed cross sectional view of the body member of the air injector assembly of FIG. 1.
Figure 2B:
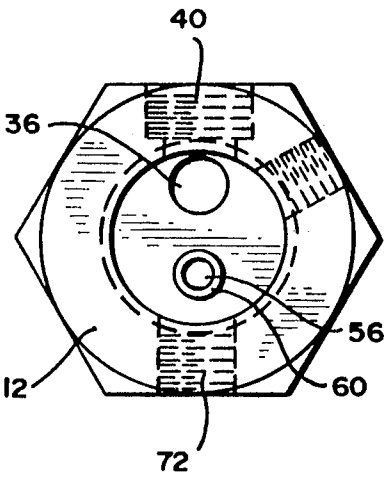
FIG. 2B is an end view of the FIG. 2A body member.

With reference to FIGS. 2A–2C, a semi-exposed cross sectional view of member 4 and its two ends are shown. Specifically, member 4 has an input port 30 and an output port 32 to which water may be received and output, respectively. Input and output pipes (not shown) are respectively mated to ends 10 and 12, via corresponding threads 8 and 34, so that a fluid such as water may pass from input port 30 to output port 32. To allow for passage of water, at least two (2) through bores 36 and 38 are formed in the central portion of member 4. Bore 36 is a bypass bore and bore 38 is a tapered bore whose dimension progressively decreases from input port 30 to output port 32. Bores 36 and 38 are separated by a solid portion 37, which may be of varying thickness, depending on how closely the bores are to be positioned relative to each other. A passage 40 tunnels from member surface 4b to bypass bore 36. The first portion of passage 40 is threaded so that passage 40 may fittingly receive bypass adjust assembly 28.

Figure 5C:
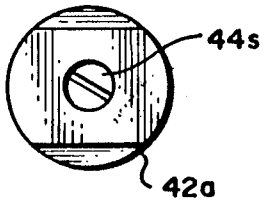
FIG. 5C is the end view of the other end of the FIG. 5A mechanism.
Figure 5A:
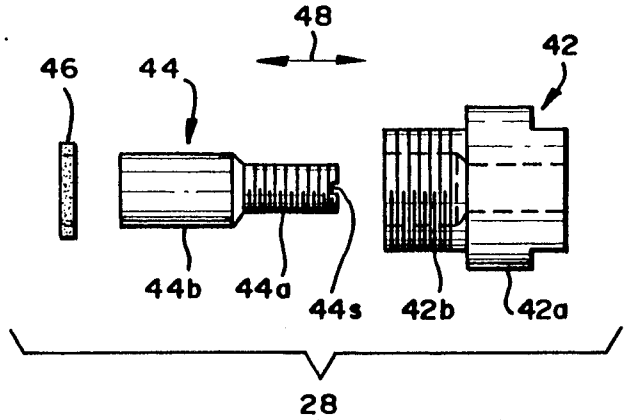
FIG. 5A is a disassembled view of the bypass mechanism for the air injector assembly of FIG. 1.
Figure 5B:
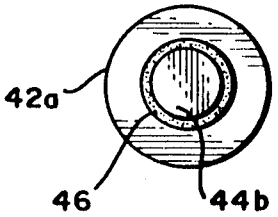
FIG. 5B is the end view of one end of the FIG. 5A mechanism.

With reference to FIGS. 5A–5C which show in detail the different components, it can be seen that bypass adjust assembly 28 comprises a base 42, a plug 44 and an O-ring 46. Base 42 has a top section 42a and a bottom section 42b, which threadedly mates to passage 40. Base 42 is hollowed throughout so that plug 44, whose upper portion 44a is threaded, may be threadedly mated to the hollow portion of base 42. As shown in FIG. 5C, portion 44a of plug 44 has a slot 44s. By turning slot 44s, plug 44 may be moved along the length of base 42, as indicated by bidirectional arrows 48 such that its lower portion 44b may penetrate into bypass bore 36. O-ring 46 fits over portion 44b of plug 44 to prevent any water from leaking through the hollow of base 42.

With reference to FIG. 2A, once base 42 is threadedly mated to passage 40, by means of portion 42b, plug lower portion 44b may be adjusted along the directions shown by arrow 48 to vary the opening of bypass bore 36.

Figure 3:
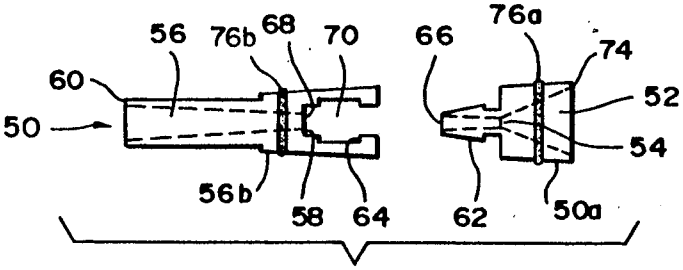
FIG. 3 is a detailed view of the air injector mechanism fitted in one of the bores of the FIG. 2A body member.

Tapered bore 38 is fitted with an air injection mechanism 50, shown in detail in FIG. 3, which has a throat portion 50a and a venturi nozzle portion 50b. Throat portion 50a has a throat opening 52 that converges to a throat 54. Venturi nozzle portion 50b has a venturi aperture 56 which progressively gets larger from surface 58 to end surface 60. Throat portion 50a is coupled to venturi nozzle 50b by extension 62 of portion 50a being locked to fingers 64 of venturi nozzle portion 50b. Once extension 62 is locked by fingers 64, portions 50a and 50b are substantially aligned such that the output of throat 54, at 66, is aligned with input 68 of venturi nozzle 56. Furthermore, a cavity 70 is formed between portions 50a and 50b for sucking in air from passage 72, which tunnels from tapered bore 38 to surface 4e at a location fluidly connected to cavity 70.

When fitted to tapered bore 38, surface 74 of throat portion 50a is flushed with interior surface 76 of member 4 which also forms the base of input port 30. See FIG. 2A. O-rings 76a and 76b ensure that fluid would only go into air injection mechanism 50 by way of throat 54 and that fluid cannot back flow from output port 32 to passage 72.

As should be appreciated, pump pressures and the amount of water flowing through different systems tend to be different. Therefore, to provide adaptability to the variations of pump pressure and the amount of water being pumped through the system (i.e., pumped gallons per minute), the dimensions of venturi nozzle 56, throat opening 52 and throat 54 can be varied to accommodate different systems. In other words, albeit the diameter of tapered bore may remain constant, the respective diameters of venturi nozzle 56, throat opening 52 and throat 54 may be increased to allow the air injector assembly of the present invention to work more efficiently if either the pump pressure or the amount of water being pumped through the system per period of time increases. Of course, the converse is equally true—that is, if a particular system has either lower pump pressure or smaller amount of water flow than a conventional system, for a more efficient operation, the respective diameters of venturi nozzle 56, throat opening 52 and throat 54 of air injector mechanism 50 may be reduced.

Figure 4C:
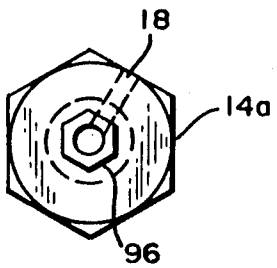
FIG. 4C is an end view of the other end of the FIG. 4A mechanism.
Figure 4A:
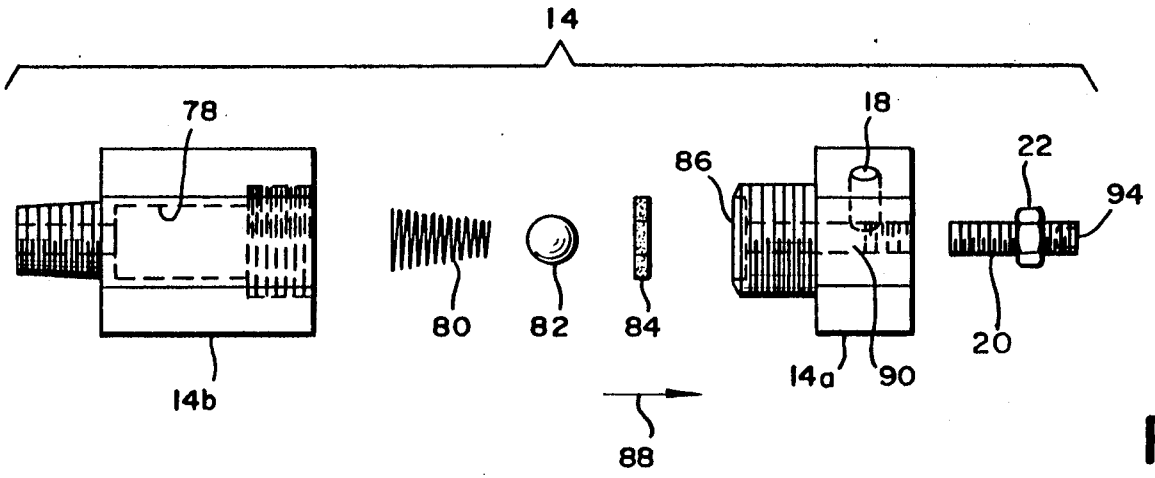
FIG. 4A is a disassembled view of the air supply mechanism for the air injector assembly of FIG. 1.
Figure 4B:
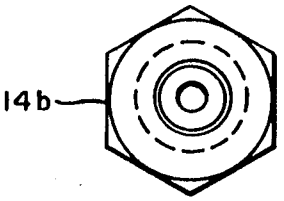
FIG. 4B is an end view of one end of the FIG. 4A mechanism.

As was discussed with reference to FIG. 1, threadedly mated to passage 72 of member 4 is air supply assembly 14, whose dissembled components are illustrated in FIG. 4A and whose end views are shown in FIGS. 4B and 4C. Since air supply assembly 14 supplies air to air injection mechanism 50, it may also be considered as an integral part of the air injection mechanism.

As shown in FIG. 4A, housing portion 146 has a cavity, indicated by dotted lines 78, to which a spring 80 is fitted. A ball check 82 is aligned with spring 80; and a gasket 84 is fitted to housing portion 14b at indentation 86. Once housing portions 14a and 14b are coupled, spring 80 provides a biasing force against ball check 82, which in turn is pressed against gasket 84 to effectively function as a valve for shutting off any possible back flow of water that may occur in the direction indicated by arrow 88.

With reference to housing portion 14a, here is shown a through bore 90 the top portion of which is threadedly mated with an adjusting screw 20. Bore 90 is fluidly connected to hole 18 from whence air may be sucked into housing 14. Screw 20 may be adjusted, by way of slot 94, such that it may extend into bore 90 to completely close off hole 18. The closing off of hole 18 is desirable when any of the housing portions 14a and 14b, ball check 82 or gasket seal 84 wears out, at which time water pressure may push water back through hole 18. A locking nut 22 ensures that once screw 20 has been properly set, it remains so.

Figure 6:
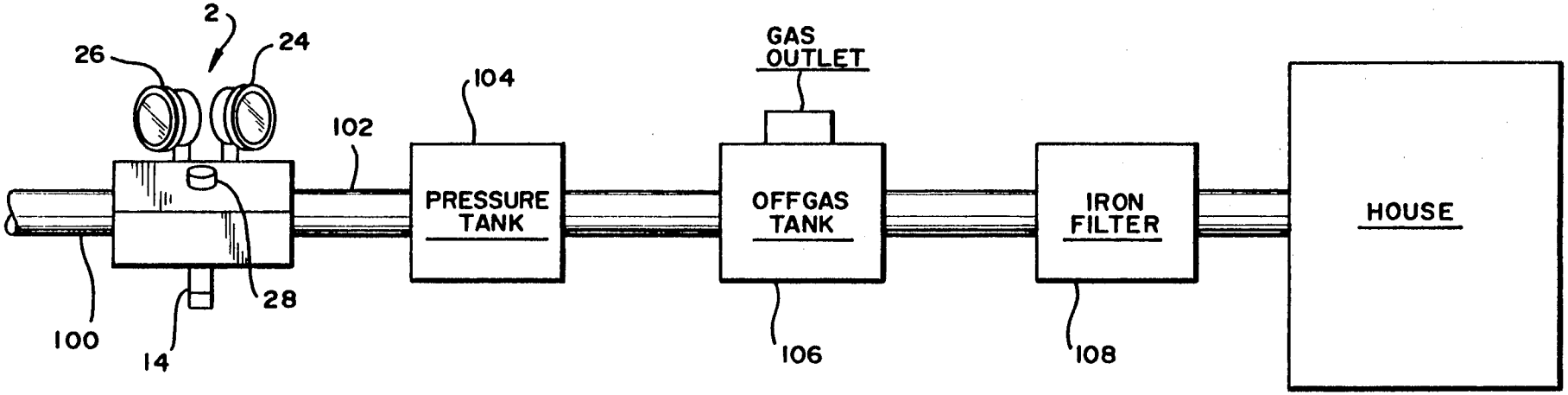
FIG. 6 is a simplified overall view of where the air injector assembly of the present invention fits into the water delivery system of a dwelling.

With air supply assembly 14, bypass adjust assembly 28 and gauges 24 and 26 properly mated to member 4, the air injection assembly can now be properly spliced into the feed water system of a dwelling, as shown in FIG. 6.

As shown, air injection assembly is connected, at its input port, to a water input pipe 100 which is connected to a pump that may be pumping water from a well. It should be appreciated that this invention is not limited to a pump as water from a municipal supply may also be applicable. The output port of air injection assembly 2 is connected to an output pipe 102 for directing the outflow water to a pressure tank 104. Thereafter the water is passed off to an off gas tank, and subsequently an iron filter 108. After that, the water is provided to the house.

To prevent corrosion, member 2, air injection mechanism 50 including portions 50*a* and 50*b*, bypass adjust base 42 and the housing of air supply assembly 14 are made of plastic, for example PVC.

In operation, assuming the pump pressure and/or the amount of water being pumped through the system is conventional and the respective diameters of venturi nozzle 56, throat 54 and throat opening 52 have been dimensioned accordingly, water is fed from pipe 100 to input port 30. The water in input port 30 is pushed through throat 54 of air injector portion 50*a* and exits at output 66 of extension 62 and fed to input 68 of venturi nozzle 56. Since throat 54 is smaller than the output of nozzle 56 at 60, a negative pressure is created at 60 such that more water is pulled through throat 54 and air sucked in from air supply assembly 14, via passage 72 to cavity 70.

Since throat 56 is relatively small, only approximately 1 ½ to 1¾ gallons of water per minute is able to traverse therethrough. However, the amount of water being pumped into pipe 100 by the pump may actually be more than what air injection portion 50 can accept if it were not for bypass bore 36. Thus, by varying the opening of bypass bore 36 (by moving plug member 44), the amount of water passing therethrough, and therefore the pressure reflected at input port 30, which is indicated by pressure gauge 26, can be adjusted.

In particular, pressure gauge 26 indicates what the back pressure is on the pump. Thus, if a 40/60 lbs. of pressure setting is envisioned in the feed water system of FIG. 6, a 60 lb pressure is to be built up in pressure tank 104. By moving plug portion 44*b* to penetrate bypass bore 36 so that the opening thereof can be varied, the amount of water passing from the input port to the output port can be controlled so that the back pressure on the pump may be adjusted and the pump may operate safely. And as air is sucked into cavity 70 while water is traversing through throat 54, the water gets aerated and oxidized. As a consequence, hydrogen sulfide is substantially eliminated from the water. Likewise, a substantial amount of iron in the water gets precipitated.

With reference to FIG. 6, the oxidized water, exiting from member 2 to pipe 102, is fed to pressure tank 104. As the pressure in the pressure tank builds up to the appropriate high setting, for example 60 lbs. of pressure, the pump is turned off. Conversely, when the pressure in pressure tank 104 falls to a preset pressure, for example 40 lbs., the pump is energized. The oxidized water is next fed to off-gas tank 106 which gets rid of the air that was drawn into the water by means of the gas outlet so that air does not come out through the faucets. Any remnant hydrogen sulfide is purged, along with the draw-in air, at this time. The water is next fed to a conventional iron filter 108 which collects the precipitate iron resulting from the water having been oxidized. The iron filter has a control valve which automatically backwashes the filter with water to get rid of the precipitated iron. The thus clear water outputting from ion filter 108 is then fed to the house.

Inasmuch as the present invention is subject to many variations, modification and changes in detail, it is intended that all matter described throughout the specification and shown in the accompanying drawings be interpreted as illustrative only and not in a limiting sense. Accordingly, it is intended that the invention be limited only by the spirit and scope of the appended claims.

What is claimed is:

1. Apparatus for oxidizing a fluid, comprising:

a member through which the fluid traverses having input and output ports for receiving and outputting the fluid respectively;

two bores each connecting said input and output ports to provide respective passageways through said member;

means adapted to one of said bores for injecting air to the fluid traversing through said member; and comprising a unitary adjustable means having a portion thereof movable within the other of said bores for varying the opening of said other bore to control the amount of fluid traversing therethrough to thereby regulate the pressure of the fluid traversing through said member and effect said air injecting means to inject an appropriate amount of air to the fluid traversing through said member to ensure that adequate oxidation of the fluid takes place.

2. Apparatus of claim 1, wherein said adjusting means comprises:

a base having a passage therethrough fixedly mated to a cavity integrated in said member and tunneled to said other bore; and a plug threadedly mated to said passage and movable therealong, said plug extendable into said other bore orthogonally to the longitudinal axis thereof for selectively varying the opening of said other bore to thereby control the amount of fluid traversing therethrough.

3. Apparatus of claim 1, wherein said member is fluidly connected to a pump, said pump driving the fluid to the input port of said member, said member further comprising:

a pressure gauge coupled to said input port of said member for obtaining a reading of the back pressure of said pump from the fluid received thereat, the opening of said other bore being varied by said adjusting means in accordance with said reading to safely operate said pump.

4. Apparatus of claim 3, further comprising:

another pressure gauge coupled to said output port of said member for obtaining a reading of the pressure of the fluid at said output port to thereby provide, along the with the reading from said pressure gauge coupled to said input port, a reference point at which said pump is to be turned on.

5. Apparatus of claim 1, wherein said air injecting means comprises:

a throat portion through which the fluid from said input port of said member traverses; and a venturi nozzle portion coupled to said throat portion and through which the oxidized fluid is outputted to said output port of said member, said throat and venturi nozzle portions are aligned lengthwise and fitted in said one bore.

6. Apparatus of claim 5, wherein said throat portion has an input orifice and said venturi nozzle portion has an output orifice, said output orifice being larger than said input orifice.

7. Apparatus of claim 5, wherein said air injection means further comprises:

air supply means mated to an aperture on said member tunneled to said one bore, said air supply means including:

a housing;

a spring biased valve means movable positioned within said housing to allow air to be sucked into said one bore only when the pressure in said one bore is lower than the ambient pressure.

8. Apparatus of claim 7, wherein said aperture is aligned substantially at the junction where said throat and venturi nozzle portions are coupled to form a cavity into which air being allowed to pass through said spring biased valve means is injected to oxidize the fluid.

9. Apparatus of claim 7, wherein said housing has a hole through which air is sucked therein; and wherein said air supply means further comprises a safety valve means for closing said hole to prevent back flow of the fluid thereat in the event said spring biased valve means malfunctions.

10. Apparatus of claim 7, wherein said member, said throat portion, said venturi nozzle portion and said housing are made from plastic to prevent corrosion thereof.

11. A device for oxidizing water, comprising:

a member through which water traverses including input and output ports for receiving and outputting water respectively;

a bypass bore through which water traverses from said input port to said output port;

a tapered bore connecting said input port to said output port, said tapered bore gets progressively smaller from said input port to said output port;

an air injection assembly fitted substantially within said tapered bore including a throat portion having an aperture through which water from said input port traverses toward said output port;

a venturi portion having a nozzle being aligned with and coupled to said throat portion, a gap separating said aperture and nozzle to form a cavity between said throat and venturi portions, air being sucked into said cavity to oxidize the water as a vacuum is effected thereat when water from said aperture traverses through said nozzle to said output port;

means movably coupled to said member and penetrable into said bypass bore for adjusting the size of said bypass bore to thereby regulate the amount of water to pass therethrough and the appropriate amount of air to be sucked into said cavity to adequately oxidize the water traversing from said input port to said output port.

12. Device of claim 11, wherein said adjusting means comprises:

a base having a passage therethrough fixedly mated to a cavity integrated in said member and tunneled to said bypass bore; and a plug threadedly mated to said passage and movable therealong, said plug penetrable into said bypass bore orthogonally to the longitudinal axis thereof for selectively varying the size of said bypass bore to thereby control the amount of water traversing therethrough.

13. Device of claim 11, further comprising:

air supply assembly mated to an aperture on said member tunneled to said tapered bore, and including a housing for enclosing a spring biased valve means which allows air to be sucked into said tapered bore via said housing only when the vacuum is maintained in said cavity.

14. Device of claim 13, wherein said housing has a hole through which air is sucked therein; and wherein said air supply assembly further comprises a safety valve means for closing said hole to prevent back flow of water thereat in the event said spring biased valve means malfunctions.

15. Device of claim 11, wherein said member is fluidly connected to a pump, said pump driving the fluid to the input port of said member, said member further comprising:

a pressure gauge coupled to said input port of said member for obtaining a reading of the back pressure of said pump from the water received thereat, the opening of said bypass bore being varied by said adjusting means in accordance with said reading to safely operate said pump.

16. Device of claim 15, further comprising:

another pressure gauge coupled to said output port of said member for obtaining a reading of the pressure of the water at said output port to thereby provide, along with the reading from said pressure gauge coupled to said input port, a reference point at which said pump is to be turned on.

* * * * *